US006365558B2

(12) United States Patent
Lal

(10) Patent No.: US 6,365,558 B2
(45) **Date of Patent: *Apr. 2, 2002**

(54) VEGETABLE OILS CONTAINING STYRENE/BUTADIENE COPOLYMERS IN COMBINATION WITH ADDITIONAL COMMERCIAL POLYMERS THAT HAVE GOOD LOW TEMPERATURE AND HIGH TEMPERATURE VISCOMETRICS

(75) Inventor: Kasturi Lal, Willoughby, OH (US)

(73) Assignee: The Lubrizol Corporation, Wickliffe, OH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 08/472,376

(22) Filed: Jun. 7, 1995

(51) Int. Cl.[7] ..... C10M 161/00

(52) U.S. Cl. ..... 508/491; 508/452; 508/457; 508/470

(58) Field of Search ..... 252/565; 508/452, 508/457, 470, 491

(56) References Cited

U.S. PATENT DOCUMENTS 4,783,274 A * 11/1988 Jokinen et al. ..... 252/32.7 E
5,298,177 A * 3/1994 Stoffa ..... 252/56 S
5,338,471 A * 8/1994 Lal ..... 252/56 S
5,399,275 A * 3/1995 Lange et al. ..... 252/56 S
5,451,332 A * 9/1995 Lawate ..... 252/56 S

* cited by examiner

*Primary Examiner*—Jacqueline V. Howard
(74) *Attorney, Agent, or Firm*—Joseph P. Fischer

(57) ABSTRACT

A composition is disclosed which comprises (A) At least one oil comprising a synthetic triglyceride, a natural oil or a derivative of a natural oil;

(B) a hydrogenated block copolymer comprising a normal block copolymer or a random block copolymer, said normal block copolymer made from a vinyl substituted aromatic and an aliphatic conjugated diene, said normal block copolymer having from two to about five polymer blocks with at least one polymer block of said vinyl substituted aromatic and at least one polymer block of said aliphatic conjugated diene, said random block copolymer made from vinyl substituted aromatic and aliphatic conjugated diene monomers, the total amount of said vinyl substituted aromatic blocks in said block copolymer being in the range of from about 20 percent to about 70 percent by weight and the total amount of said diene blocks in said block copolymer being in the range of from about 30 percent to about 80 percent by weight; the number average molecular weight of said normal block copolymer and said random block copolymer being in the range of about 5,000 to about 1,000,000; and (C) at least one pour point depressant.

In addition to components (A), (B), and (C) the composition may also contain (D) a performance additive.

36 Claims, No Drawings

VEGETABLE OILS CONTAINING STYRENE/BUTADIENE COPOLYMERS IN COMBINATION WITH ADDITIONAL COMMERCIAL POLYMERS THAT HAVE GOOD LOW TEMPERATURE AND HIGH TEMPERATURE VISCOMETRICS

FIELD OF THE INVENTION

The present invention relates to vegetable oils, at least one styrene/butadiene copolymer and a pour point depressant to give a composition that has good viscometrics at both high and low temperature. The composition may also contain a performance additive to enhance the performance in areas of anti-wear, oxidation inhibition, rust/corrosion inhibition, metal passivation, extreme pressure, friction modification, viscosity modification, foam inhibition, emulsification, demulsification, lubricity, dispersancy, detergency, and the like.

BACKGROUND OF THE INVENTION

Successful use of vegetable oils and other biodegradable oils as environmentally friendly base fluids in industrial applications is contingent on improving their viscometries and low temperature flow properties. For example, a sunflower oil containing an oleic acid content of 80 percent has a pour point of −12° C. and turns solid in the Brookfield viscosity measurement. Many of the industrial applications require a pour point of less than −25° C. and a Brookfield viscosity of 7500 to 150,000 centi poises (cP) at −25° C.

U.S. Pat. No. 2,336,195 (Sparks et al, Dec. 7, 1943) relates to improving viscosity characteristics of hydrocarbon oils by the addition of normal mono-oflefin polymers. A normal mono-oflefin polymer is converted to a high molecular weight polymer by compressing an olefin, such as ethylene or propylene, to a high superatomspheric pressure in excess of 500 atmospheres.

U.S. Pat. No. 3,554,911 (Schiff et al, Jan. 12, 1971) relates to improved lubricating oils, particularly mineral lubricating oils, and processes of preparing the same. In another aspect, this reference relates to the addition of a small amount of a hydrogenated random butadiene-styrene copolymer to lubrication oils to produce formulations that are shear stable and have a high viscosity index (V.I.). Accordingly, this reference relates to hydrogenated random butadiene-styrene copolymers having defined amounts of butadiene and styrene which are blended with suitable mineral oils to increase the viscosity and improve the viscosity index.

U.S. Pat. No. 3,772,169 (Small et al, Nov. 13, 1973) provides an oil composition which comprises:

1. a lubricating oil,
2. a random copolymer of butadiene and styrene containing 30–44 percent weight of units derived from butadiene and 56–70 percent weight of units derived from styrene, which copolymer has been hydrogenated until at least 95 percent of the olefinic double bonds and at most 5 percent of the aromatic unsaturation has been saturated, and
3. an oil-soluble polyester which comprises molecular unit derived from an alkyl ester of an α-olefinically unsaturated carboxylic acid in which the alkyl chain or chains contain(s) at least 7 carbon atoms.

U.S. Pat. No. 3,772,196 (St. Clair et al, Nov. 13, 1973) provides for lubricating oil compositions for internal combustion engines that have unexpectedly wide temperature operating characteristics. This composition contains a combination of a 2-block copolymer comprising a first polymer block of an alkenyl arene, e.g., styrene and a second essentially completely hydrogenated polymer block of isoprene and certain pour point depressants in a lubricant base stock having a viscosity index of at least 85.

SUMMARY OF THE INVENTION

A composition is disclosed which comprises (A) At least one oil comprising a synthetic triglyceride, a natural oil or a derivative of a natural oil;

(B) a hydrogenated block copolymer comprising a normal block copolymer or a random block copolymer, said normal block copolymer made from a vinyl substituted aromatic and an aliphatic conjugated diene, said normal block copolymer having from two to about five polymer blocks with at least one polymer block of said vinyl substituted aromatic and at least one polymer block of said aliphatic conjugated diene, said random block copolymer made from vinyl substituted aromatic and aliphatic conjugated diene monomers, the total amount of said vinyl substituted aromatic blocks in said block copolymer being in the range of from about 20 percent to about 70 percent by weight and the total amount of said diene blocks in said block copolymer being in the range of from about 30 percent to about 80 percent by weight; the number average molecular weight of said normal block copolymer and said random block copolymer being in the range of about 5,000 to about 1,000,000; and (C) at least one pour point depressant.

In addition to components (A), (B), and (C) the composition may also contain (D) a performance additive.

DETAILED DESCRIPTION OF THE INVENTION

(A) The Synthetic Triglyceride, Natural Oil or Derivative of a Natural Oil

In practicing this invention, a synthetic triglyceride or a natural oil is employed of the formula

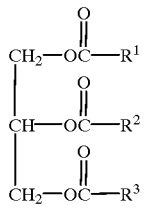

wherein $R^1$, $R^2$ and $R^3$ are aliphatic hydrocarbyl groups that contain from about 7 to about 23 carbon atoms and preferably from about 11 to about 21 carbon atoms. The term "hydrocarbyl group" as used herein denotes a radical having a carbon atom directly attached to the remainder of the molecule. The aliphatic hydrocarbyl groups include the following:

(1) Aliphatic hydrocarbon groups; that is, alkyl groups such as heptyl, nonyl, undecyl, tridecyl, heptadecyl; alkenyl groups containing a single double bond such as heptenyl, nonenyl, undecenyl, tridecenyl, heptadecenyl, heneicosenyl; alkenyl groups containing 2 or 3 double bonds such as 8,11-heptadecadienyl and 8,11,14-heptadecatrienyl. All isomers of these are included, but straight chain groups are preferred.

(2) Substituted aliphatic hydrocarbon groups; that is groups containing non-hydrocarbon substituents which, in the context of this invention, do not alter the predominantly hydrocarbon character of the group. Those skilled in the art will be aware of suitable substituents; examples are hydroxy, carbalkoxy, (especially lower carbalkoxy) and alkoxy (especially lower alkoxy), the term, "lower" denoting groups containing not more than 7 carbon atoms.

(3) Hetero groups; that is, groups which, while having predominantly aliphatic hydrocarbon character within the context of this invention, contain atoms other than carbon present in a chain or ring otherwise composed of aliphatic carbon atoms. Suitable hetero atoms will be apparent to those skilled in the art and include, for example, oxygen, nitrogen and sulfur.

Naturally occurring oils are vegetable oil triglycerides. The synthetic triglycerides are those formed by the reaction of one mole of glycerol with three moles of a fatty acid or mixture of fatty acids. Preferred are vegetable oil triglycerides. The preferred vegetable oils are soybean oil, rapeseed oil,sunflower oil, coconut oil, canola oil, peanut oil, safflower oil and palm olein.

In a preferred embodiment, the aliphatic hydrocarbyl groups are such that the triglyceride has a monounsaturated character of at least 60 percent, preferably at least 70 percent and most preferably at least 80 percent. Naturally occurring triglycerides having utility in this invention are exemplified by vegetable oils that are genetically modified such that they contain a higher than normal oleic acid content. Normal sunflower oil has an oleic acid content of 25–30 percent. By genetically modifying the seeds of sunflowers, a sunflower oil can be obtained wherein the oleic content is from about 60 percent up to about 90 percent. That is, the $R^1$, $R^2$ and $R^3$ groups are heptadecenyl groups and the $R^1COO^-$, $R^2COO^-$ and $R^3COO^-$ to the 1,2,3-propanetriyl group $-CH_2CHCH_2-$ are the residue of an oleic acid molecule. U.S. Pat. Nos. 4,627,192 and 4,743,402 are herein incorporated by reference for their disclosure to the preparation of high oleic sunflower oil.

For example, a triglyceride comprised exclusively of an oleic acid moiety has an oleic acid content of 100% and consequently a monounsaturated content of 100%. Where the triglyceride is made up of acid moieties that are 70% oleic acid, 10% stearic acid, 13% palmitic acid, and 7% linoleic acid, the monounsaturated content is 70%. The preferred triglyceride oils are high oleic (at least 60 percent) acid triglyceride oils. Typical high oleic vegetable oils employed within the instant invention are high oleic safflower oil, high oleic canola oil, high oleic peanut oil, high oleic corn oil, high oleic rapeseed oil, high oleic sunflower oil, high oleic soybean oil, high oleic cottonseed oil, and high oleic palm olein. Canola oil is a variety of rapeseed oil containing less than 1 percent eruic acid. A preferred high oleic vegetable oil is high oleic sunflower oil obtained from Helianthus sp. This product is available from SVO Enterprises Eastlake, Ohio as Sunyl® high oleic sunflower oil. Sunyl 80 oil is a high oleic triglyceride wherein the acid moieties comprise 80 percent oleic acid. Another preferred high oleic vegetable oil is high oleic rapeseed oil obtained from *Brassica campestris* or *Brassica napus*, also available from SVO Enterprises as RS high oleic rapeseed oil. RS80 oil signifies a rapeseed oil wherein the acid moieties comprise 80 percent oleic acid.

It is further to be noted that genetically modified vegetable oils have high oleic acid contents at the expense of the di- and tri-unsaturated acids. A normal sunflower oil has from 20–40 percent oleic acid moieties and from 50–70 percent linoleic acid moieties. This gives a 90 percent content of mono- and di-unsaturated acid moieties (20+70) or (40+50). Genetically modifying vegetable oils generate a low di- or tri-unsaturated moiety vegetable oil. The genetically modified oils of this invention have an oleic acid moiety:linoleic acid moiety ratio of from about 2 up to about 90. A 60 percent oleic acid moiety content and 30 percent linoleic acid moiety content of a triglyceride oil gives a ratio of 2. A triglyceride oil made up of an 80 percent oleic acid moiety and 10 percent linoleic acid moiety gives a ratio of 8. A triglyceride oil made up of a 90 percent oleic acid moiety and 1 percent linoleic acid moiety gives a ratio of 90. The ratio for normal sunflower oil is 0.5 (30 percent oleic acid moiety and 60 percent linoleic acid moiety).

The derivative of a natural oil is formed by reacting a natural oil comprising animal fat or vegetable oils with an alcohol. These natural oils are triglycerides of the formula

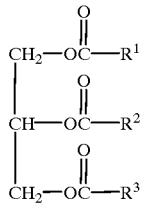

wherein $R^1$, $R^2$ and $R^3$ are as defined above.

Animal fats having utility are beef tallow oil and menhaden oil. Useful vegetable oils are sunflower oil, cottonseed oil, safflower oil, corn oil, soybean oil, rapeseed oil, or any of the previously mentioned vegetable oils within component (A) that are genetically modified such that the monounsaturated content is greater than the normal value.

Alcohols utilized in forming the transesterified esters are of the formula $R^4OH$ wherein $R^4$ is an aliphatic group that contains from 1 to about 24 carbon atoms. The $R^4$ may be straight chained or branched chain, saturated or unsaturated. An illustrative but non exhaustive list of alcohols are: methyl alcohol, ethyl alcohol, n-propyl alcohol, isopropyl alcohol and the isomeric butyl, pentyl, hexyl, heptyl, octyl, nonyl dodecyl, pentadecyl and octadecyl alcohols. Preferably the alcohols are methyl alcohol and n-propyl alcohol.

The transesterification occurs by mixing at least 3 moles of $R^4OH$ per 1 mole of triglyceride. A catalyst, when employed, comprises alkali or alkaline earth metal alkoxides containing from 1 up to 6 carbon atoms. Preferred catalysts are sodium or potassium methoxide, calcium or magnesium methoxide, the ethoxides of sodium, potassium, calcium or magnesium and the isomeric propoxides of sodium, potassium, calcium or magnesium. The most preferred catalyst is sodium methoxide.

The transesterification occurs at a temperature of from ambient up to the decomposition temperature of any reactant or product. Usually the upper temperature limit is not more than 150° C. and preferably not more than 120° C. In the transesterification mixed esters are obtained according to the following reaction:

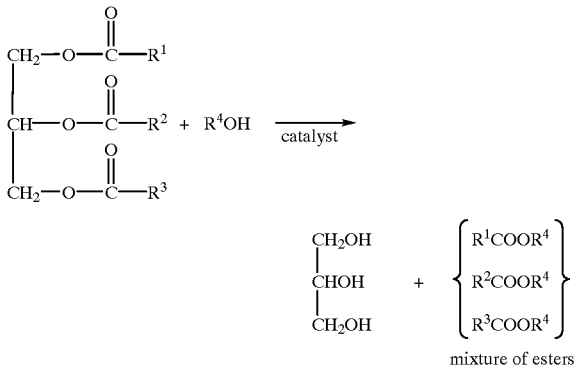

Transesterification is an equilibrium reaction. To shift the equilibrium to the right it is necessary to use either a large excess of alcohol, or else remove glycerol as it is formed. When using an excess of alcohol, once the transesterification reaction is complete the excess alcohol is removed by distillation.

The following examples are illustrative of the preparation of the transesterified product of the present invention. Unless otherwise indicated, all parts and percentages are by weight.

EXAMPLE A-1

Charged to a 12 liter 4 neck flask is 7056 parts (8 moles) high oleic (80%) rapeseed oil, 1280 parts (40 moles) absolute methyl alcohol and 70.5 parts (1.30 moles) sodium methoxide. The contents are heated to a reflux temperature of 73° C. and held at this temperature for 3 hours and 76 parts (0.65 moles) of 85% phosphoric acid is added dropwise in 0.4 hours to neutralize the catalyst. Excess methyl alcohol is then removed by heating to 100° C. with nitrogen blowing at 0.2 cubic feet per hour and later to a vacuum of 30 millimeters of mercury. The contents are filtered to give 6952 parts of the transesterified methyl ester of high oleic rapeseed oil.

EXAMPLE A-2

The procedure of Example A-1 is essentially followed except that the high oleic rapeseed oil is replaced with high oleic (80%) sunflower oil to give the transesterified methyl ester of high oleic sunflower oil.

EXAMPLE A-3

Charged to a 5 liter 4 neck flask is 759 parts (12.5 moles) isopropyl alcohol. While at room temperature, 5.75 parts (0.25 moles) elemental sodium is slowly added. When all the sodium is reacted, added is 2205 parts (2.5 moles) high oleic (80%) sunflower oil. The contents are heated to 85° C. and held for 4 hours followed by neutralization of the catalyst with 9.67 parts (0.083 moles) of 85% phosphoric acid. The contents are stripped to 120° C. at 27 millimeters of mercury to give 2350 parts of the transesterified isopropyl ester of high oleic sunflower oil.

EXAMPLE A-4

The procedure of Example A-3 is essentially followed except that the catalyst is made by reacting 690 parts (15 moles) absolute ethyl alcohol with 6.9 parts (0.3 moles) sodium metal and then followed by the addition of 2646 parts (3.0 moles) high oleic (80%) sunflower oil. The catalyst is neutralized with 11.6 parts (0.10 moles) of 85% phosphoric acid. The product obtained is the transesterified ethyl ester of high oleic sunflower oil.

EXAMPLE A-5

The procedure of Example A-4 is essentially followed except that the catalyst is made by reacting 910 parts (15 moles) n-propyl alcohol with 6.9 parts (0.3 moles) sodium metal. The product obtained is the transesterified n-propyl ester of high oleic sunflower oil.

EXAMPLE A-6

The procedure of Example A-4 is followed except that the catalyst is made by reacting 1114.5 parts (15 moles) n-butyl alcohol with 6.9 parts (0.3 moles) sodium metal. The product obtained is the transesterified n-butyl ester of high oleic sunflower oil.

EXAMPLE A-7

The procedure of Example A-3 is essentially followed except that the catalyst is made by reacting 1300 (12.5 moles) n-hexyl alcohol with 5.75 parts (0.25 moles) sodium metal and then followed by the addition of 2205 parts (2.5 moles) high oleic (80%) sunflower oil. The catalyst is neutralized with 9.7 parts (0.083 moles) of 85% phosphoric acid. The product obtained is the transesterified n-hexyl ester of high oleic sunflower oil.

EXAMPLE A-8

Utilizing the catalyst as prepared in Example A-3, safflower oil is transesterified with isopropyl alcohol to obtain transesterified isopropyl esters of safflower oil.

EXAMPLE A-9

Utilizing the catalyst as prepared in Example A-4, cottonseed oil is transesterified with ethyl alcohol to obtain transesterified ethyl esters of cottonseed oil.

EXAMPLE A-10

Utilizing the catalyst as prepared in Example A-6, corn oil is transesterified with n-butyl alcohol to obtain transesterified n-butyl esters of corn oil.

EXAMPLE A-11

The procedure of Example A-9 is essentially followed except that beef tallow oil is utilized instead of cottonseed oil. The product obtained is the transesterified ethyl ester of beef tallow oil.

EXAMPLE A-12

The procedure of Example A-10 is essentially followed except that menhaden oil is utilized instead of corn oil. The product obtained is the transesterified n-butyl ester of menhaden oil.

EXAMPLE A-13

The procedure of Example A-1 is essentially followed except that rapeseed oil is utilized instead of high oleic rapeseed oil. The product obtained is the transesterified methyl ester of rapeseed oil.

EXAMPLE A-14

The procedure of Example A-1 is essentially followed except that soybean oil is utilized instead of high oleic rapeseed oil. The product obtained is the transesterified methyl ester of soybean oil.

(B) The Hydrogenated Block Copolymer

Considering the (B) hydrogenated block copolymer, it comprises either a normal block copolymer, that is a true block copolymer or a random block copolymer. Considering the true or normal block copolymer, it is generally made from conjugated dienes having from 4 to 10 carbon atoms and preferably from 4 to 6 carbon atoms as well as from vinyl substituted aromatics having from 8 to 12 carbon atoms and preferably 8 or 9 carbon atoms.

Examples of vinyl substituted aromatics include styrene, alpha-methylstyrene, ortho-methylstyrene, meta-methylstyrene, para-methylstryrene, para-tertiary-butylstyrene, with styrene being preferred. Examples of such conjugated dienes include piperylene, 2, 3-dimethyl-1, 3-butadiene, chloroprene, isoprene and 1, 3-butadiene with isoprene and 1, 3-butadiene being particularly preferred. Mixtures of such conjugated dienes are useful.

The normal block copolymers have a total of from 2 to about 5, and preferably 2 or 3, polymer blocks of the vinyl substituted aromatic and the conjugated diene with at least one polymer block of said vinyl substituted aromatic and at least one polymer block of said conjugated dienes being present. The conjugated diene block is hydrogenated as more fully set forth hereinbelow. The normal block copolymers can be linear block copolymers wherein a substantially long sequence of one monomeric unit (Block I) is linked with another substantially long sequence of a second (Block II), third (Block III), fourth (Block IV), or fifth (Block V) monomeric unit. For example, if a is a styrene monomeric unit and d is a conjugated diene monomeric unit, a tri-block copolymer of these monomeric unit can be represented by the formula:

```
aaaa--aa-ddd-ddd-aaa--aa
Block I  Block II  Block III
    Linear A B A Block
```

These copolymers can also be radial block copolymers wherein the polymer blocks are linked radically as represented by the formula:

```
aaa--aa--aa--aaa
        |
        ddd--ddd
Radial A B Block
```

In practice, the number of repeat units involved in each polymer block usually exceeds about 500, but it can be less than about 500. The sequence length in one block should be long enough so that the block copolymer exhibits the inherent homopolymeric physical properties such as glass transition temperature and polymer melt temperature.

The vinyl substituted aromatic content of these copolymers, that is the total amount of vinyl substituted aromatic blocks in the normal block copolymer, is in the range of from about 20 percent to about 70 percent by weight and preferably from about 40 percent to about 60 percent by weight. Thus, the aliphatic conjugated diene content, that is the total diene block content, of these copolymers is in the range of from about 30 percent to about 80 percent by weight and preferably from about 40 percent to about 60 percent by weight.

These normal block copolymers can be prepared by conventional methods well known in the art. Such copolymers usually are prepared by anionic polymerization using, for example, an alkali metal hydrocarbon (e.g., sec-butyllithium) as a polymerization catalyst.

Examples of suitable normal block copolymers as set forth above include Shellvis-40 and Shellvis-50, both hydrogenated styrene-isoprene block copolymers, manufactured by Shell Chemicals.

Considering the random block copolymer which can be utilized separately, in combinations with the normal block copolymers set forth above, or not at all, it is generally defined as a block copolymer having one or more block polymer portions therein. More specifically, the random block copolymers can be defined as an indeterminate number of a and d blocks of indeterminate lengths. These random copolymers are generally made from conjugated dienes of the type noted above and hereby incorporated by reference with butadiene or isoprene being preferred. The remaining monomer utilized to make the random block copolymer comprises vinyl substituted aromatics of the type set forth hereinabove and are also hereby fully incorporated by reference. A suitable type of aromatic monomer is styrene. The random block copolymer can be made by simultaneously feeding a mixture of monomers to a polymerization system rather than by feeding the monomers in a sequential manner. The amount of the various blocks by weight are the same as set forth above, that is from about 20 to about 70 percent by weight of vinyl substituted aromatic block with 40 to 60 percent by weight of such blocks being preferred. Accordingly, the amount of the diene blocks is the difference. The number average molecular weight and the weight average molecular weight of the random block copolymers are the same as set forth above and accordingly are hereby fully incorporated by reference. The random block copolymers contain significant blocks of a vinyl substituted aromatic repeating unit and/or significant blocks of a conjugated diene repeating unit therein and/or blocks of random or random tapered conjugated diene/vinyl substituted aromatic. These copolymers can also be represented as by A'-B'-A'-B'- wherein A' is a block of vinyl substituted aromatic compound. B' is a block of conjugated diene, and the length of A' and B' blocks vary widely and, are substantially shorter than the A and B blocks of a normal block copolymer. The amount of the aromatic A block content of the random block copolymer preferably should be in the range of about 15 to about 45, more preferably 25 to about 40 weight percent.

Examples of such commercially available random block copolymers include the various Glissoviscal block copolymers manufactured by BASF. A previously available random block copolymer was Phil-Ad viscosity improver, manufactured by Phillips Petroleum.

Regardless of whether a true (normal block) copolymer or a random block copolymer, or combinations of both are utilized, they are hydrogenated before use so as to remove virtually all of their olefinic double bonds. Techniques for accomplishing this hydrogenation are well know to those of skill in the art and need not be described in detail at this point. Briefly, hydrogenation is accomplished by contacting the copolymers with hydrogen at superatomospheric pressures in the presence of a metal catalyst such as colloidal nickel, palladium on charcoal, etc.

In general, it is preferred that these block copolymers, for reasons of oxidative stability, contain no more than about 5 percent and preferably no more than about 0.5 percent residual olefinic unsaturation on the basis of the total number of carbon-to-carbon covalent linkages within the average molecule. Such unsaturation can be measured by a number of means well known to those of skill in the art, such as infrared, NMR, etc. Most preferably, these copolymers contain no discernible unsaturation as determined by the afore-mentioned analytical techniques.

The (B) block copolymers typically have number average molecular weight in the range of about 5,000 to about 1,000,000 preferably about 30,000 to about 200,000. The weight average molecular weight for these copolymers is generally in the range of about 50,000 to about 500,000, preferably about 30,000 to about 300,000.

(C) The Pour Point Depressant

A drawback of using high monounsaturated triglycerides is in the difficulty with congelation of the oil at low temperatures (less than -10° C.). This difficulty arises from a natural stiffening at low temperatures of the triglyceride analogous to the stiffening of honey or molasses at a reduced temperature. To maintain the "pour" or "flow" of the triglyceride oil, a pour point depressant is added to the oil.

Pour point depressants (PPD) having utility in this invention are carboxy containing interpolymers in which many of the carboxy groups are esterified and the remaining carboxy groups, if any, are neutralized by reaction with amino compounds; acrylate polymers, nitrogen containing acrylate polymers and methylene linked aromatic compounds.

Carboxy-Containing Interpolymers

This PPD is an ester of a carboxy-containing interpolymer, said interpolymer having a reduced specific viscosity of from about 0.05 to about 2, and being derived from at least two monomers, one of said monomers being a low molecular weight aliphatic olefin, styrene or substituted styrene wherein the substituent is a hydrocarbyl group containing from 1 up to about 18 carbon atoms, and the other of said monomers being an alpha, beta-unsaturated aliphatic acid, anhydride or ester thereof, said ester being substantially free of titratable acidity, i.e., at least 90% esterification, and being characterized by the presence within its polymeric structure of pendant polar groups which are derived from the carboxy group of acid ester: (a) a relatively high molecular weight carboxylic ester group having at least 8 aliphatic carbon atoms in the ester radical, optionally (b) a relatively low molecular weight carboxylic ester group having no more than 7 aliphatic carbon atoms in the ester radical, and optionally (c) a carbonyl-polyamino group derived from a polyamino compound having one primary or secondary amino group, wherein the molar ratio of (a): (b) is (1–20):1, preferably (1–10): 1 and wherein the molar ratio of (a):(b):(c) is (50–100):(5–50):(0. 1–15)

In reference to the size of the ester groups, it is pointed out that an ester radical is represented by the formula

—C(O)(OR)

and that the number of carbon atoms in an ester radical is the combined total of the carbon atoms of the carbonyl group and the carbon atoms of the ester group i.e., the (OR) group.

An optional element of this ester is the presence of a polyamino group derived from a particular amino compound, i.e., one in which there is one primary or secondary amino group and at least one mono-functional amino group. Such polyamino groups, when present in this mixed ester in the proportion stated above enhances the dispensability of such esters in lubricant compositions and additive concentrates for lubricant compositions.

Still another essential element of the mixed ester is the extent of esterification in relation to the extent of neutralization of the unesterified carboxy groups of the carboxy-containing interpolymer through the conversion thereof to the optional polyamino-containing groups. For convenience, the relative proportions of the high molecular weight ester group to the low molecular weight ester group and to the polyamino group when these latter two components are utilized are expressed in terms of molar ratios of (50–100):(5–50):(0.1–15), respectively. The preferred ratio is (70–85):(15–30):(3–4). It should be noted that the linkage described as the carbonyl-polyamino group may be imide, amide, or amidine and inasmuch as any such linkage is contemplated within the present invention, the term "carbonyl polyamino" is thought to be a convenient, generic expression useful for the purpose of defining the inventive concept. In a particularly advantageous embodiment of the invention such linkage is imide or predominantly imide.

Still another important element of the mixed ester is the molecular weight of the carboxy-containing interpolymer. For convenience, the molecular weight is expressed in terms of the "reduced specific viscosity" of the interpolymer which is a widely recognized means of expressing the molecular size of a polymeric substance. As used herein, the reduced specific viscosity (abbreviated as RSV) is the value obtained in accordance with the formula $$RSV = \frac{\text{Relative Viscosity} - 1}{\text{Concentration}}$$

wherein the relative viscosity is determined by measuring, by means of a dilution viscometer, the viscosity of a solution of one gram of the interpolymer in 10 ml. of acetone and the viscosity of acetone at 30°±0.02° C. For purpose of computation by the above formula, the concentration is adjusted to 0.4 gram of the interpolymer per 100 ml. of acetone. A more detailed discussion of the reduced specific viscosity, also known as the specific viscosity, as well as its relationship to the average molecular weight of an interpolymer, appears in Paul J. Flory, *Principles of Polymer Chemistry*, (1953 Edition) pages 308 et seq.

While interpolymers having reduced specific viscosity of from about 0.05 to about 2 are contemplated in the mixed ester, the preferred interpolymers are those having a reduced specific viscosity of from about 0.1 to about 1. In most instances, interpolymers having a reduced specific viscosity of from about 0.1 to about 0.8 are particularly preferred.

From the standpoint of utility, as well as for commercial and economical reasons, esters in which the high molecular weight ester group has from 8 to 24 aliphatic carbon atoms, the low molecular weight ester group has from 3 to 5 carbon atoms, and the carbonyl amino group is derived from a primary-aminoalkyl-substituted tertiary amine, particularly heterocyclic amines, are preferred. Specific examples of the high molecular weight carboxylic ester group, i.e., the (OR) group of the ester radical (i.e., —(O)(OR)) include heptyloxy, isooctyloxy, decyloxy, dodecyloxy, tridecyloxy, tetradecyloxy, pentadecyloxy, octadecyloxy, eicosyloxy, tricosyloxy, tetracosyloxy, etc. Specific examples of low molecular weight groups include methoxy, ethoxy, n-propyloxy, isopropyloxy, n-butyloxy, sec-butyloxy, isobutyloxy, n-pentyloxy, neo-pentyloxy, n-hexyloxy, cyclohexyloxy, xyxlopentyloxy, 2-methyl-butyl-1-oxy, 2,3-dimethyl-butyl-1-oxy, etc. In most instances, alkoxy groups of suitable size comprise the preferred high and low molecular weight ester groups. Polar substituents may be present in such ester groups. Examples of polar substituents are chloro, bromo, ether, nitro, etc.

Examples of the carbonyl polyamino group include those derived from polyamino compounds having one primary or secondary amino group and at least one mono-functional amino group such as tertiary-amino or heterocyclic amino group. Such compounds may thus be tertiary-amino substituted primary or secondary amines or other substituted primary or secondary amines in which the substituent is derived from pyrroles, pyrrolidones, caprolactams, oxazolidones, oxazoles, thiazoles, pyrazoles, pyrazolines, imidazoles, imidazolines, thiazines, oxazines, diazines, oxycarbamyl, thiocarbamyl, uracils, hydantoins, thiohydantoins, guanidines, ureas, sulfonamides, phosphoramides, phenothiaznes, amidines, etc. Examples of such polyamino compounds include dimethylamino-ethylamine, dibutylamino-ethylamine, 3-dimethylamino-1-propylamine, 4-methylethylamino-1-butylamine, pyridyl-ethylamine, N-morpholino-ethylamine, tetrahydropyridyl-ethylamine, bis-(dimethylamino)propyl-amine, bis-(diethylamino)ethylamine, N,N-dimethyl-p-phenylene diamine, piperidyl-ethylamine, 1-aminoethyl pyrazole, 1-(methylamino)pyrazoline, 1-methyl-4-amino-octyl pyrazole, l-aminobutyl imidazole, 4-aminoethyl thiazole, 2-aminoethyl pyridine, ortho-amino-ethyl-N,N-dimethylbenzenesulfarnide, N-aminoethyl phenothiazine, N-aminoethylacetamidine, 1-aminophenyl-2-aminoethyl pyridine, N-methyl-N-aminoethyl-S-ethyl-dithiocarbamate, etc. Preferred polyamino compounds include the N-aminoalkyl-substituted morpholines such as aminopropyl morpholine. For the most part, the polyamino compounds are those which contain only one primary-amino or secondary-amino group and, preferably at least one tertiary-amino group. The tertiary amino group is preferably a heterocyclic amino group. In some instances polyamino compounds may contain up to about 6 amino groups although, in most instances, they contain one primary amino group and either one or two tertiary amino groups. The polyamino compounds may be aromatic or aliphatic amines and are preferably heterocyclic amines such as amino-alkyl-substituted morpholines, piperazines, pyridines, benzopyrroles, quinolines, pyrroles, etc. They are usually amines having from 4 to about 30 carbon atoms, preferably from 4 to about 12 carbon atoms. Polar substituents may likewise be present in the polyamines.

The carboxy-containing interpolymers include principally interpolymers of alpha, beta-unsaturated acids or anhydrides such as maleic anhydride or itaconic anhydride with olefins (aromatic or aliphatic) such as ethylene, propylene, isobutene or styrene, or substituted styrene wherein the substituent is a hydrocarbyl group containing from 1 up to about 18 carbon atoms. The styrene-maleic anhydride interpolymers are especially useful. They are obtained by polymerizing equal molar amounts of styrene and maleic anhydride, with or without one or more additional interpolymerizable comonomers. In lieu of styrene, an aliphatic olefin may be used, such as ethylene, propylene or isobutene. In lieu of maleic anhydride, acrylic acid or methacrylic acid or ester thereof may be used. Such interpolymers are know in the art and need not be described in detail here. Where an interpolymerizable comonomer is contemplated, it should be present in a relatively minor proportion, i.e., less that about 0.3 mole, usually less than about 0.15 mole, per mole of either the olefin (e.g. styrene) or the alpha, beta-unsaturated acid or anhydride (e.g. maleic anhydride). Various methods of interpolymerizing styrene and maleic anhydride are known in the art and need not be discussed in detail here. For purpose of illustration, the interpolymerizable comonomers include the vinyl monomers such as vinyl acetate, acrylonitrile, methylacrylate, methylmethacrylate, acrylic acid, vinyl methyl either, vinyl ethyl ether, vinyl chloride, isobutene or the like.

The nitrogen-containing esters of the mixed ester are most conveniently prepared by first 100 percent esterifying the carboxy-containing interpolymer with a relatively high molecular weight alcohol and a relatively low molecular weight alcohol. When the optional (c) is employed, the high molecular weight alcohol and low molecular weight alcohol are utilized to convert at least about 50% and no more than about 98% of the carboxy radicals of the interpolymer to ester radicals and then neutralizing the remaining carboxy radicals with a polyamino compound such as described above. To incorporate the appropriate amounts of the two alcohol groups into the interpolymer, the ratio of the high molecular weight alcohol to the low molecular weight alcohol used in the process should be within the range of from about 2:1 to about 9:1 on a molar basis. In most instances the ratio is from about 2.5:1 to about 5:1. More than one high molecular weight alcohol or low molecular weight alcohol may be used in the process; so also may be used commercial alcohol mixtures such as the so-called Oxoalcohols which comprise, for example mixtures of alcohols having from 8 to about 24 carbon atoms. A particularly useful class of alcohols are the commercial alcohols or alcohol mixtures comprising decylalcohol, dodecyl alcohol, tridecyl alcohol, tetradecyl alcohol, pentadecyl alcohol, hexadecyl alcohol, heptadecyl alcohol and octadecyl alcohol. Other alcohols useful in the process are illustrated by those which, upon esterification, yield the ester groups exemplified above.

The extent of esterification, as indicated previously, may range from about 50% to about 98% conversion of the carboxy radicals of the interpolymer to ester radicals. In a preferred embodiment, the degree of esterification ranges from about 75% to about 95%.

The esterification can be accomplished simply be heating the carboxy-containing interpolymer and the alcohol or alcohols under conditions typical for effecting esterification. Such conditions usually include, for example, a temperature of at least about 80° C., preferably from about 150° C. to about 350° C., provided that the temperature be below the decomposition point of the reaction mixture, and the removal of water of esterification as the reaction proceeds. Such conditions may optionally include the use of an excess of the alcohol reactant so as to facilitate esterification, the use of a solvent or diluent such as mineral oil, toluene, benzene, xylene or the like and a esterification catalyst such as toluene sulfonic acid, sulfuric acid, aluminum chloride, boron trifluoride-triethylamine, hydrochloric acid, ammonium sulfate, phosphoric acid, sodium methoxide or the like. These conditions and variations thereof are well know in the art.

A particularly desirable method of effecting esterification involves first reacting the carboxy-containing interpolymer with the relatively high molecular weight alcohol and then reacting the partially esterified interpolymer with the relatively low molecular weight alcohol. A variation of this technique involves initiating the esterification with the relatively high molecular weight alcohol and before such esterification is complete, the relatively low molecular weight alcohol is introduced into the reaction mass so as to achieve a mixed esterification. In either event it has been discovered that a two-step esterification process whereby the carboxy-containing interpolymer is first esterified with the relatively high molecular weight alcohol so as to convert from about 50% to about 75% of the carboxy radicals to ester radicals and then with the relatively low molecular weight alcohol to achieve the finally desired degree of esterification results in products which have unusually beneficial viscosity properties.

The esterified interpolymer may optionally be treated with a polyamino compound in an amount so as to neutralize substantially all of the unesterified carboxy radicals of the interpolymer. The neutralization is preferably carried out at a temperature of at least about 80° C., often from about 120° C. to about 300° C., provided that the temperature does not exceed the decomposition point of the reaction mass. In most instances the neutralization temperature is between about 150° C. and 250° C. A slight excess of the stoichiometric amount of the amino compound is often desirable, so as to insure substantial completion of neutralization, i.e., no more than about 2% of the carboxy radicals initially present in the interpolymer remained unneutralized.

The following examples are illustrative of the preparation of the mixed ester of the present invention. Unless otherwise indicated all parts and percentages are by weight.

EXAMPLE (C-1)

A styrene-maleic interpolymer is obtained by preparing a solution of styrene (16.3 parts by weight) and maleic anhydride (12.9 parts) in a benzene-toluene solution (270 parts; weight ratio of benzene:toluene being 66.5:33.5) and contacting the solution at 86° C. in nitrogen atmosphere for 8 hours with a catalyst solution prepared by dissolving 70% benzoyl peroxide (0.42 part) in a similar benzene-toluene mixture (2.7 parts). The resulting product is a thick slurry of the interpolymer in the solvent mixture. To the slurry there is added mineral oil (141 parts) while the solvent mixture is being distilled off at 150° C. and then at 150° C./200 mm. Hg. To 209 parts of the stripped mineral oil-interpolymer slurry (the interpolymer having a reduced specific viscosity of 0.72) there are added toluene (25.2 parts), n-butyl alcohol (4.8 parts), a commercial alcohol consisting essentially of primary alcohols having from 12 to 18 carbon atoms (56.6 parts) and a commercial alcohol consisting of primary alcohols having from 8 to 10 carbon atoms (10 parts) and to the resulting mixture there is added 96% sulfuric acid (2.3 parts). The mixture is then heated at 150°–160° C. for 20 hours whereupon water is distilled off. An additional amount of sulfuric acid (0.18 part) together with an additional amount of n-butyl alcohol (3 parts) is added and the esterification is continued until 95% of the carboxy radicals of the polymer has been esterified. To the esterified interpolymer, there is then added aminopropyl morpholine (3.71 parts; 10% in excess of the stoichiometric amount required to neutralize the remaining free carboxy radicals) and the resulting mixture is heated to 150°–160° C./10 mm. Hg to distill off toluene and any other volatile components. The stripped product is mixed with an additional amount of mineral oil (12 parts) filtered. The filtrate is a mineral oil solution of the nitrogen-containing mixed ester having a nitrogen content of 0.16–0.17%.

EXAMPLE (C-2)

The procedure of Example (C-1) is followed except that the esterification is carried out in two steps, the first step being the esterification of the styrene-maleic interpolymer with the commercial alcohols having from 8 to 18 carbon atoms and the second step being the further esterification of the interpolymer with n-butyl alcohol.

EXAMPLE (C-3)

The procedure of Example (C-1) is followed except that the esterification is carried out by first esterifying the styrene-maleic interpolymer with the commercial alcohol having from 8 to 18 carbon atoms until 70% of the carboxyl radicals of the interpolymer have been converted to ester radicals and thereupon continuing the esterification with any yet-unreacted commercial alcohols and n-butyl alcohol until 95% of the carbonyl radicals of the interpolymer have been converted to ester radicals.

EXAMPLE (C-4)

The procedure of Example (C-1) is followed except that the interpolymer is prepared by polymerizing a solution consisting of styrene (416 parts), maleic anhydride (392 parts), benzene (2153 parts) and toluene (5025 parts) in the presence of benzoyl peroxide (1.2 parts) at 65°106° C. (The resulting interpolymer has a reduced specific viscosity of 0.45).

EXAMPLE (C-5)

The procedure of Example (C-1) is followed except that the styrene-maleic anhydride is obtained by polymerizing a mixture of styrene (416 parts), maleic anhydride (392 parts), benzene (6101 parts) and toluene (2310 parts) in the presence of benzoyl peroxide (1.2 parts) at 78°–92° C. (The resulting interpolymer has a reduced specific viscosity of 0.91).

EXAMPLE (C-6)

The procedure of Example (C-1) is followed except that the styrene-maleic anhydride is prepared by the following procedure: Maleic anhydride (392 parts) is dissolved in benzene (6870 parts). To this mixture there is added styrene (416 parts) at 76° C. whereupon benzoyl peroxide (1.2 parts) is added. The polymerization mixture is maintained at 80–82° C. for about 5 hours. (The resulting interpolymer has a reduced specific viscosity of 1.24.)

EXAMPLE (C-7)

The procedure of Example (C-1) is followed except that acetone (1340 parts) is used in place of benzene as the polymerization solvent and that azobisisobutyronitrile (0.3 part) is used in place of benzoyl peroxide as a polymerization catalyst.

EXAMPLE (C-8)

An interpolymer (0.86 carboxyl equivalent) of styrene and maleic anhydride (prepared from an equal molar mixture of styrene and maleic anhydride and having a reduced specific viscosity of 0.69) is mixed with mineral oil to form a slurry, and then esterified with a commercial alcohol mixture (0.77 mole; comprising primary alcohols having from 8 to 18 carbon atoms) at 150–160° C. in the presence of a catalytic amount of sulfuric acid until about 70% of the carboxyl radicals are converted to ester radicals. The partially esterified interpolymer is then further esterified with a n-butyl alcohol (0.31 mole) until 95% of the carboxyl radicals of the interpolymer are converted to the mixed ester radicals. The esterified interpolymer is then treated with aminopropyl morpholine (slight excess of the stoichiometric amount to neutralize the free carboxyl radicals of the interpolymer) at 150–160° C. until the resulting product is substantially neutral (acid number of 1 to phenolphthalein indicator). The resulting product is mixed with mineral oil so as to form an oil solution containing 34% of the polymeric product.

Examples (C-1) through (C-8) are prepared using mineral oil as the diluent. All of the mineral oil or a portion thereof may be replaced with the triglyceride oil (A) as is illustrated in Examples (C-9) to (C-il). The preferred triglyceride oil is the high oleic sunflower oil.

EXAMPLE (C-9)

Charged to a 12 liter 4 neck flask is 3621 parts of the interpolymer of Example (C-8) as a toluene slurry. The percent toluene is about 76 percent. Stirring is begun and 933 parts (4.3 equivalents) Alfol 1218 alcohol and 1370 parts xylene are added. The contents are heated and toluene is removed by distillation. Additional xylene is added in increments of 500, 500, 300 and 300 parts while continuing to remove toluene, the object being to replace the lower boiling toluene with the higher boiling xylene. The removal of solvent is stopped when the temperature of 140° C. is reached. The flask is then fitted with an addition funnel and the condenser is set to reflux. At 140° C., 23.6 parts (0.17 equivalents) methanesulfonic acid in 432 parts (3 equivalents) Alfol 810 alcohol is added in about 20 minutes. The contents are stirred overnight at reflux while collecting water in a Dean Stark trap. Then added is 185 parts (2.5 equivalents) of n-butanol containing therein 3.0 parts (0.02 equivalents) of methanesulfonic acid. This addition occurs over a 60 minute time period. The contents are maintained at reflux for 8 hours and then an additional 60 parts (0.8 equivalents) n-butanol is added and the contents are permitted to reflux overnight. At 142° C. is added 49.5 parts (0.34 equivalents) aminopropylmorpholine in 60 minutes. After a 2 hour reflux 13.6 parts (equivalents) 50% aqueous sodium hydroxide is added over 60 minutes and after an additional 60 minutes of stirring there is added 17 parts of an alkylated phenol.

To a 1 liter flask is added 495 parts of the above esterified product. The contents are heated to 140° C. and 337 parts Sunyl® 80 oil is added. Solvent is removed at 155° C. with nitrogen blowing at 1 cubic foot per hour. The final stripping conditions are 155° C. and 20 mm Hg. At 100° C. the contents are filtered using diatomaceous earth. The filtrate is a vegetable oil solution of the nitrogen-containing mixed ester having a nitrogen content of 0.14%.

Examples (C-10) and (C-11) employ an interpolymerizable monomer as part of the carboxy-containing interpolymer.

EXAMPLE (C-10)

One mole each of maleic anhydride and styrene and 0.05 moles methyl methacrylate are polymerized in toluene in the presence of benzoyl peroxide (1.5 parts) at 75–95° C. The resulting interpolymer has a reduced specific viscosity of 0.13 and is a 12% slurry in toluene. Added to a 2 liter 4 neck flash is 868 parts (1 equivalent) of the polymer along with 68 parts (0.25 equivalents) oleyl alcohol, 55 parts (0.25 equivalents) Neodol 45, 55 parts (0.25 equivalents) Alfol 1218 and 36 parts (0.25 equivalents) Alfol 8–10. The contents are heated to 115° C. and added is 2 parts (0.02 moles) methanesulfonic acid. After a 2 hour reaction period, toluene is distilled off. With a neutralization number of 18.7 to phenolphthalein (indicating an 89% esterification), 15 parts (0.20 equivalents) n-butanol is added dropwise over 5 hours. The neutralization number/esterification level is 14.0/92.5%. Then added is 1.6 parts (0.02 moles) 50% aqueous sodium hydroxide to neutralize the catalyst. This is followed by the addition of 5.5 parts (0.038 equivalents) of aminopropylmorpholine and 400 parts Sunyl® 80 oil. The contents are vacuum stripped to 15 millimeters mercury at 100° C. and filtered using a diatomaceous earth filter aid. The filtrate is the product containing 0.18 percent nitrogen and 54.9 percent Sunyl® 80 oil.

The following example is similar to Example (C-10) but employs different alcohols and different levels in a different order of addition.

EXAMPLE (C-11)

Added to a 2 liter 4 neck flask is 868 parts (1 equivalent) of the polymer of Example (C-10), 9.25 parts (0.125 equivalents) isobutyl alcohol, 33.8 parts (0.125 equivalents) oleyl alcohol, 11 parts each (0.125 equivalents) of 2-methyl-1-butanol, 3-methyl-1-butanol and 1-pentanol, 23.4 parts (0.125 equivalents) hexyl alcohol, and 16.25 parts each (0.125 equivalents) 1-octanol and 2-octanol. At 1 10C 2 parts (0.02 moles) methanesulfonic acid is added. One hour later toluene is distilled off and when the distillation is complete, the neutralization number/esterification level is 62.5/70 percent. At 140° C. 31.2 parts (0.43 equivalents) n-butanol is added dropwise over 28 hours and the neutralization number/esterification level is 36.0/79.3 percent. At 120° C. 0.3 parts (0.03 moles) methanesulfonic acid is added followed by 20.4 parts (0.20 equivalents) hexyl alcohol. After esterification the neutralization number/esterification level is 10.5/95 percent. Then added is 1.9 parts (0.023 moles) of 50% sodium hydroxide followed by 5.9 parts (0.04 equivalents aminopropylmorpholine and 400 parts Sunyl® 80 oil. The contents are filtered and the product has a nitrogen analysis of 0.18 percent.

Acrylate Polymers

In another aspect Component (C) is at least one hydrocarbon-soluble acrylate polymer of the formula

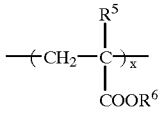

wherein $R^5$ is hydrogen or a lower alkyl group containing from 1 to about 4 carbon atoms, $R^6$ is a mixture of alkyl, cycloalkyl or aromatic groups containing from about 4 to about 24 carbon atoms, and x is an integer providing a weight average molecular weight (Mw) to the acrylate polymer of about 5000 to about 1,000,000.

Preferably $R^5$ is a methyl or ethyl group and more preferably, a methyl group. $R^6$ is primarily a mixture of alkyl groups containing from 4 to about 18 carbon atoms. In one embodiment, the weight average molecular weight of the acrylate polymer is from about 50,000 to about 500,000 and in other embodiments, the molecular weight of the polymer may be from 100,000 to about 500,000 and 300,000 to about 500,000.

Specific examples of the alkyl groups $R^6$ which may be included in the polymers of the present invention include, for example, n-butyl, octyl, decyl, dodecyl, tridecyl, octadecyl, hexadecyl, octadecyl. The mixture of alkyl groups can be varied so long as the resulting polymer is hydrocarbon-soluble.

The following examples are illustrative of the preparations of the acrylate polymers of the present invention. All parts and percentages are by weight unless indicated to the contrary.

EXAMPLE (C-12)

Added to a 2 liter 4 neck flask is 50.8 parts (0.20 moles) lauryl methacrylate, 44.4 parts (0.20) isobornyl methacrylate, 38.4 parts (0.20 moles) 2-phenoxy ethyl acrylate, 37.6 parts (0.20 moles) 2-ethylhexyl acrylate, 45.2 parts (0.20 moles) isodecyl methacrylate and 500 parts toluene. At 100° C. 1 parts Vazo® 67 (2,2' azobis(2-methylbutyronitrile)) in parts toluene is added over 7 hours. The reaction is held at 100° C. for 16 hours after which the temperature is increased to 120° C. to remove toluene and added is 216 parts of Sunyl® 80 oil. Volatiles are removed by vacuum distillation at 20 millimeters mercury at 140° C. The contents are filtered to give the desired product.

EXAMPLE (C-13)

Added to a 2 liter 4 neck flask is 38.1 parts (0.15 moles) lauryl methacrylate, 48.6 parts (0.15 moles) stearyl acrylate, 28.2 parts (0.15 moles) 2-ethylhexyl methacrylate, 25.5 parts (0.15 moles) tetrahydrofurfuryl methacrylate, 33.9 parts (0.15 moles) isodecyl methacrylate and 500 parts toluene. At 100° C. 1 part Vazo® 67 in 20 parts toluene is added dropwise in 6 hours. After the addition is complete, the reaction mixture is held at 100° C. for 15.5 hours, toluene is distilled out and 174 parts Sunyl® 80 oil is added. The contents are vacuum stripped at 140° C. at 20 millimeters of mercury and filtered to give the desired product.

An example of a commercially available methacrylate ester polymer which has been found to be useful in the present invention is sold under the tradename of "Acryloid 702" by Rohin and Haas, wherein $R^1$ is predominantly a mixture of n-butyl, tridecyl, and octadecyl groups. The weight average molecular weight (Mw) of the polymer is about 404,000 and the number average molecular weight (Mn) is about 118,000. Another commercially available methacrylate polymer useful in the present invention is available under the tradename of "Acryloid 954" by Rohm and Haas, wherein $R^6$ is predominantly a mixture of n-butyl, decyl, tridecyl, octadecyl, and tetradecyl groups. The weight average molecular weight of Acryloid 954 is found to be about 440,000 and the number average molecular weight is about 111,000. Each of these commercially available methacrylate polymers is sold in the form of a concentrate of about 40% by weight of the polymer in a light-colored mineral lubricating oil base. When the polymer is identified by the tradename, the amount of material added is intended to represent an amount of the commercially available Acryloid material including the oil.

Other commercially available polymethacrylates are available from Rohm and Haas Company as Acryloid 1253, Acryloid 1265, Acryloid 1263, Acryloid 1267, from Rohm GmbH as Viscoplex 0410, Viscoplex 10–930, Viscoplex 5029, from Societe Francaise D'Organo-Synthese as Garbacryl T-84, Garbacryl T-78S, from Texaco as TLA 233, TLA 5010 and TC 10124. Some of these polymethacrylates may be PMA/OCP (olefin copolymer) type polymers.

Methylene Linked Aromatic Compounds

Another PPD having utility in this invention is a mixture of compounds having the general structural formula:

$$Ar\text{-}((R^7)\text{—}X_n\text{—}[Ar'(R^8)]_{n'}\text{—}Ar''$$

wherein the Ar, Ar' and Ar" are independently an aromatic moiety containing 1 to 3 aromatic rings and each aromatic moiety is substituted with 0 to 3 substituents (the preferred aromatic precursor being naphthalene), $R^7$ and $R^8$ are independently straight or branch chain alkylenes containing 1 to 100 carbon atoms, n is 0 to 1000, n' is 0 or 1 and X is a hydrocarbylene group containing from 1 up to 24 carbon atoms.

This PPD is characterized by the presence of compounds over a wide molecular weight range, generally from about 300 to about 300,000 and preferably from about 300 to about 10,000. The molecular weight of compounds in the composition of the invention could vary from that of a simple unsubstituted benzene to a polymer of 1000 monomers of trisubstituted naphthalenes linked by alkylenes containing as many as 100 carbon atoms with the substituents of the naphthalene containing 1 to 50 carbon atoms.

The substituents for the aromatic moieties are obtained from olefins and/or chlorinated hydrocarbons.

The useful olefins include 1-octene, 1-decene, and alpha-olefins of chain lengths $C_{12}$, $C_{14}$, $C_{16-18}$, $C_{15-20}$, $C_{20-24}$, $C_{24-28}$. More preferably invention process is carried out with olefins which are mixtures of the above. A good example would be the $C_{15-20}$ cracked wax olefins, or a mixture of 1-octene and $C_{16-18}$ alpha olefin.

The chlorinated hydrocarbons might contain from 1–50 carbon atoms and from about 2 to about 84% chlorine by weight. Preferred chlorinated hydrocarbons are obtained by chlorinating slack waxes or paraffinic' waxes of $C_{18-30}$ chain length so that they contain from 5–50% chlorine by weight. A particularly preferred chlorinated hydrocarbon, being one of about 24 carbons containing about 2.5 chlorines per 24 carbon atoms.

Although Ar, Ar' and Ar" may be any aromatic containing 1 to 3 aromatic rings, it is preferable if Ar, Ar' and Ar" are all the same. Further, it is preferable if Ar, Ar' and Ar" are fused benzene rings, i.e., when two or three benzene rings are present, the adjoining rings share two carbon atoms. Most preferably, Ar, Ar' and Ar" are all derived from naphthalene.

Aromatics which might be precursors of Ar, Ar' and Ar" include benzene, biphenyl, diphenylmethane, triphenylmethane, aniline, diphenylamine, diphenylether, phenol, naphthalene, anthracene and phenanthrene. Naphthalene is particularly preferred.

Although the aromatic groups of the general formula above can contain 0 to 3 substituents, the composition will contain compounds with one or two substituents and will preferably include compounds with two substituents. The substituents may be derived from any olefin (preferably an alpha olefin containing 8 to 30 carbon atoms) or derived from a chlorinated hydrocarbon containing 8 to 50 carbon atoms (preferably a chlorinated hydrocarbon derived from a hydrocarbon wax containing 22–26 carbon atoms). In addition to or in place of forming the substituents, the olefin and/or chlorinated hydrocarbon may form the alkylene linking group ($R^7$ and $R^8$ groups) of the general structural formula. Compositions of the invention might include compounds wherein each of the naphthalene groups is substituted with one alkyl group containing 16 to 18 carbon atoms and one derived from a chlorinated hydrocarbon containing about 24 carbon atoms with about 2.5 chlorine atoms present for each 24 carbon atoms.

The desired material is a mixture of products which include alkylated naphthalenes, coupled and bridged naphthalenes, oligomers and dehydrohalogenated waxes. The Mw distribution of the final product is a more useful characterization of the final product. A useful Mw range is from 300–20,000. A more useful Mw range is from 300 to 10,000. A preferred distribution is from 400 to 112,000. The most useful distribution is from about 300 to about 300,000.

A disclosure on how to prepare methylene linked aromatic compounds can be found in U.S. Pat. No. 4,753,745. A typical procedure for the preparation of methylene linked aromatic compound is disclosed as Example C-14. U.S. Pat.

No. 4,753,745 is hereby incorporated by reference for its disclosure to the methylene linked aromatic compounds.

EXAMPLE C-14

Naphthalene is mixed with seven parts of $CH_2C1_2$ and 0.2 parts of $A1C1_3$. Chlorinated hydrocarbon (2.7 parts) is added slowly into the reaction mixture at 15° C. The reaction mixture is held for 5 hours at ambient temperature or until the release of HC 1 is complete. The mixture is then cooled to about 5° C. and 7.3 parts of an alpha olefin mixture is added over 2 hours while maintaining the temperature of the reaction mixture between 0 and 10° C.

The catalyst is decomposed by the careful addition of 0.8 parts 50% aqueous NaOH. The aqueous layer is separated and the organic layer is purged with $N_2$ and heated to 140° C. and 3mm Hg to remove the volatiles. The residue is filtered to yield 97% of the theoretical yield weight of the product.

Nitrogen-Containing Polyacrylate Esters

Component (C) may also be a nitrogen-containing polyacrylate ester prepared by reacting an acrylate ester of the formula

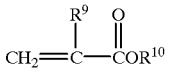

wherein $R^9$ is hydrogen or an alkyl group containing from 1 to about 8 carbon atoms and $R^{10}$ is an alkyl, cycloalkyl or aromatic group containing from 4 to about 24 carbon atoms with a nitrogen containing compound. For each mole of the acrylate ester from 0.001–1.0 moles of the nitrogen containing compound is employed. The reaction is carried out at a temperature of from 50° C. up to about 250° C. Non-limiting examples of nitrogen containing compounds are 4-vinylpyridine, 2-vinylpyridine, 2-N-morpholinoethyl methacrylate, N,N-dimethylaminoethyl methacrylate, and N,N-dimethylaminopropyl methacrylate.

The following example is illustrative of the preparation of the nitrogen-containing polymethacrylate. All parts and percentages are by weight unless indicated otherwise.

EXAMPLE (C-15)

Added to a 2 liter 4 neck flask is 50.8 parts (0.2 moles) lauryl methacrylate, 44.4 parts (0.20 moles) isobornyl methacrylate, 38.4 parts (0.20 moles) 2-phenoxyethyl acrylate, 37.6 parts (0.20 moles) 2-ethylhexyl acrylate, 45.2 parts (0.20 moles) isodecyl methacrylate, 21 parts (0.20 moles) 4-vinylpyridine and 500 parts toluene. At 100° C. 1 part Vazo 67 in parts toluene is added dropwise in 8 hours. After maintaining the temperature at 100° C. for an additional 20 hours, an additional 0.5 parts Vazo 67 in 10 parts toluene is added in 3 hours. Toluene is then removed by distillation, 235 parts Sunyl® 80 is added and the contents are vacuum stripped to 25 millimeters mercury at 140° C. The contents are filtered to give a product with 0.71 percent nitrogen.

A few companies that make nitrogen-containing polyacrylates are Rohm and Haas, Rohm GmbH, Texaco, Albright & Wilson, Societe Francaise and D'Organo-Synthese (SFOS).

(D) The Performance Additive

In addition to components (A), (B) and (C) the compositions of this invention may also include (D) a performance additive. The performance enhanced by these additives in the areas of anti-wear, oxidation inhibition, rust/corrosion inhibition, metal passivation, extreme pressure, friction modification, viscosity modification, foam inhibition, emulsification, demulsification, lubricity, dispersancy and detergency and the like.

The performance additive (D) is selected from the group consisting of (1) an alkyl phenol,
(2) a benzotriazole,
(3) a thiocarbamate,
(4) a sulfurized composition,
(5) a viscosity index improver,
(6) an aromatic amine,
(7) a mineral oil, and
(8) a synthetic ester oil (D)(1) The Alkyl Phenol Component (D-1) is an alkyl phenol of the formula

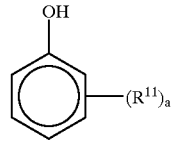

wherein $R^{11}$ is an alkyl group containing from 1 up to about 24 carbon atoms and a is an integer of from 1 up to 5. Preferably $R^{11}$ contains from 4 to 18 carbon atoms and most preferably from 4 to 12 carbon atoms. $R^{11}$ may be either straight chained or branched chained and branched chained is preferred. The preferred value for a is an integer of from 1 to 4 and most preferred is from 1 to 3. An especially preferred value for a is 2. When a is not 5, it is preferred that the position para to the OH group be open.

Mixtures of alkyl phenols may be employed. Preferably the phenol is a butyl substituted phenol containing 2 or 3 t-butyl groups. When a is 2, the t-butyl groups occupy the 2,6-position, that is, the phenol is sterically hindered:

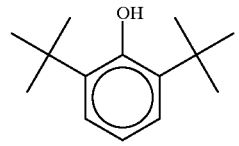

When a is 3, the t-butyl groups occupy the 2,4,6-position.

(D)(2) The Benzotriazole

The benzotriazole compound of the formula

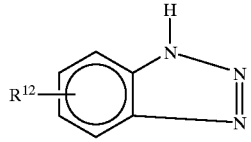

wherein $R^{12}$ is hydrogen a straight or branched-chain alkyl group containing from 1 up to about 24 carbon atoms, preferably 1 to 12 carbon atoms and most preferably 1 carbon atom. When $R^{12}$ is 1 carbon atom the benzotriazole compound is tolyltriazole of the formula

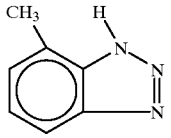

Tolyltriazole is available under the trade name Cobratec TT-100 from Sherwin-Williams Chemical.

(D)(3) The Thiocarbamate

The thiocarbamates having utility in this invention are of the formula

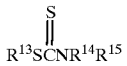

wherein $R^{13}$ is an alkyl group containing from 1 to about 24 carbon atoms, phenyl or alkyl phenyl wherein the alkyl group contains from 1 to about 18 carbon atoms. Preferably $R^{13}$ is an alkyl group containing from 1 to 6 carbon atoms. The groups $R^{14}$ and $R^{15}$ are hydrogen or an alkyl group containing from 1 to about 6 carbon atoms, with the proviso that $R^{14}$ and $R^{15}$ are not both hydrogen.

(D)(4) The Sulfurized Composition

Component (D)(4) is a sulfurized composition prepared by sulfurizing a mixture comprising three essential reagents. Reagent (D)(4)(a) is a fatty oil; that is, at least one naturally occurring ester of glycerol and a fatty acid, or a synthetic ester of similar structure. Such fatty oils are animal or vegetable oil tryiglycerides of the formula

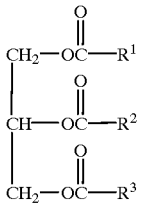

wherein $R^1$, $R^2$ and $R^3$ are aliphatic groups containing from about 7 to about 23 carbon atoms. A non-exhaustive list of reagent (D)(4)(a) include lard oil, peanut oil, cottonseed oil, soybean oil and corn oil. Reagent (D)(4)(a) is the same as component (A) disclosed above.

Regent (D)(4)(b) is at least one alkenyl carboxylic acid containing from about 8 to about 30 carbon atoms. The alkenyl carboxylic acids are ordinarily free from acetylenic unsaturation. Suitable acids include (preferably) monocarboxylic acids such as oleic acid, linoleic acid, linolenic acid, 14-hydroxy-11-eicosenic acid and ricinoleic acid. In particular, reagent (D)(4)(b) may be an unsaturated fatty acid such as oleic or linoleic acid, and may be a mixture of acids such as is obtained from tall oil or by the hydrolysis of peanut oil, soybean oil or the like. The amount of reagent (D)(4)(b) used is about 2–50 parts by weight per 100 parts of reagent (D)(4)(a); about 2–8 parts by weight is preferred.

Regent (D)(4)(c) is at least one substantially aliphatic monoolefin containing from about 8 to about 36 carbon atoms, and is present in the amount of about 25–400 parts by weight per 1000 parts of reagent (D)(4)(a). Suitable olefins include the octenes, decenes, dodecenes, eicosenes and triacontenes, as well as analogous compounds containing aromatic or non-hydrocarbon substituents which are substantially inert in the context of this invention. (As used in the specification and appended claims, the term "substantially inert" when used to refer to solvents, diluents, substituents and the like is intended to mean that the solvent, diluent, substituent, etc. is inert to chemical or physical change under the conditions which it is used so as not to interfere materially in an adverse manner with the preparation, storage, blending and/or functioning of the composition, additive, compound, etc. in the context of its intended use). For example, small amounts of a solvent, diluent, substituent, etc. can undergo minimal reaction or degradation without preventing the making and using of this component as described herein. In other words, such reaction or degradation, while technically discernible, would not be sufficient to deter a worker of ordinary skill in the art from making and using this component for its intended purposes. "Substantially inert" as used herein is, thus, readily understood and appreciated by those of ordinary skill in the art. Terminal olefins, or α-olefins, are preferred, especially those containing from about 12 to about 20 carbon atoms. Especially preferred are straight chain a olefins. Mixtures of these olefins are commercially available and such mixtures are contemplated for use in this invention.

The sulfurized composition used as component (D)(4) is prepared by reacting a mixture comprising reagents (D)(4)(a), (D)(4)(b) and (D)(4)(c) with a sulfurizing agent at a temperature between about 100I C and about 250° C., usually between about 1500 and about 210° C. The sulfurizing reagent may be, for example, sulfur, a sulfur halide such as sulfur monochloride or sulfur dichloride, a mixture of hydrogen sulfide and sulfur dioxide, or the like. Elemental sulfur is often preferred and the invention especially contemplates the use of sulfurized composition prepared by reacting sulfur with the aforesaid mixture. The weight ratio of the combination of reagents (D)(4)(a), (D)(4)(b) and (D)(4)(c) to sulfur is between about 5:1 and about 15:1, generally between about 5:1 and about 10:1

In addition to the above described reagent, the reaction mixture may contain other materials. These may include, for example, sulfurization promoters, typically phosphorus-containing reagent such as phosphorous acid esters such as lecithin.

The sulfurization reaction is effected by merely heating the reagents at the temperature indicated above, usually with efficient agitation and in an inert atmosphere (e.g., nitrogen). If any of the reagents, especially regent (D)(4)(c), are appreciably volatile at the reaction temperature, the reaction vessel may be maintained under pressure. It is frequently advantageous to add sulfur portionwise to the mixture of the other reagents. While it is usually preferred of the reagent previously described, the reaction may also be effected in the presence of a substantially inert organic diluent (e.g., an alcohol, ether, ester, aliphatic hydrocarbon, halogenated aromatic hydrocarbon or the like) which is liquid within the temperature range employed. When the reaction temperature is relatively high, e.g., about 200° C., there may be some evolution of sulfur from the product which is avoided if a lower reaction temperature (e.g., from about 1500 to about 170° C.) is used. However, the reaction sometimes requires a longer time at lower temperatures and an adequate sulfur content is usually obtained when the temperature is at the high end of the recited range.

Following the reaction, volatile materials may be removed by blowing with air or nitrogen and insoluble by products by filtration, usually at an elevated temperature (from about 80° to about 120° C.). The filtrate is the desired sulfur product.

U.S. Pat. Nos. 3,926,822 and 3,953,347 are incorporated by reference herein for their disclosures of suitable sulfurized compositions useful as component (D). Several specific sulfurized compositions are described in examples 10–18 of U.S Pat. No. 3,926,822 and 10–19 of U.S Pat. No. 3,953,347. The following example illustrates the preparation of one such composition. (In the specification and claims, all parts and percentages are by weight unless otherwise indicated.)

EXAMPLE (D)(4-1)

A mixture of 100 parts of soybean oil, 5.25 parts of tall oil acid and 44.8 parts of commercial $C_{15-18}$ straight chain œ-olefins is heated to 167° C. under nitrogen, and 17.4 parts of sulfur is added. The temperature of the mixture rises to 208° C. Nitrogen is blown over the surface at 165–200° C. for 6 hours and the mixture is then cooled to 90° C. and filtered. The filtrate is the desired product and contains 10.6% sulfur.

(D)(5) The Viscosity Index Improver

Viscosity Index or "V.I." is an arbitrary number which indicates the resistance of a lubricant to viscosity change with temperature. The Dean and Davis viscosity index calculated from the observed viscosities of a lubricant at 40° C. and 100° C. gives V.I. values ranging from 0 or negative values to values of 200 or more. The higher its V.I. value, the greater the resistance of a lubricant to thicken at low temperatures and thin out at high temperatures.

An ideal lubricant for most purposes would possess the same viscosity at all temperatures. All lubricants depart from this ideal, some more than others. For example, lubricating oils derived from highly paraffinic crudes have higher V.I. values than lubricating oils derived from highly naphthenic crudes. This difference was used, in fact, to fix the limits of 0 to 100 on the Dean and Davis scale, these values having been assigned, respectively, to a poor naphthene-base oil and a good paraffin-base oil. The operational advantages offered by a lubricant having a high V.I. include principally less friction due to viscous "drag" at low temperatures as well as reduced lubricant loss and lower wear at high temperatures.

V.I. improvers are chemicals which are added to lubricating oils to make them conform more closely to the ideal lubricant defined above. Although a few non-polymeric substances such as metallic soaps exhibit V.I. improving properties, all commercially important V.I. improvers are oil-soluble organic polymers. Suitable polymers exert a greater thickening effect on oil at high temperatures than they do at lower temperatures. The end result of such selective thickening is that the oil suffers less viscosity change with changing temperature, i.e., its V.I. is raised. It has been proposed that selective thickening occurs because the polymer molecule assumes a compact, curled form in a poor solvent such as cold oil and an uncurled, high surface area form in a better solvent such as hot oil. In the latter form, it is more highly solvated and exerts its maximum thickening effect on the oil.

Commercial V.I. improvers belong to the following families of polymers:

(I) Polyisobutenes (II) Polymethacrylates, i.e., copolymers of various chain length alkyl methacrylates (III) Vinyl acetate—fumaric acid ester copolymers (IV) Polyacrylates, i.e., copolymers of various chain length alkyl acrylates (D)(6) The Aromatic Amine Component (D)(6) is at least one aromatic amine of the formula

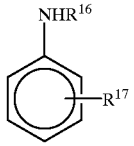

wherein $R^{16}$ is

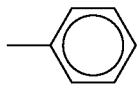

or

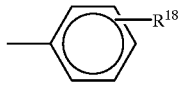

and $R^{17}$ and $R^{18}$ are independently a hydrogen or an alkyl group containing from 1 up to 24 carbon atoms.

Preferably $R^{16}$ is

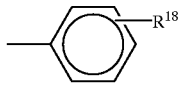

and $R^{17}$ and $R^{18}$ are alkyl groups containing from 4 up to about 18 carbon atoms. In a particularly advantageous embodiment, component (D)(6) comprises alkylated diphenylamine such as nonylateddiphenylamine of the formula

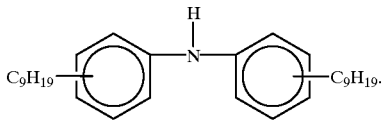

(D)(7) The Mineral Oil

The mineral oils having utility are mineral lubricating oils such as liquid petroleum oils and solvent-treated or acid-treated mineral lubricating oils of the paraffinic, naphthenic or mixed paraffrnic-naphthenic types. Also useful are petroleum distillates such as VM&P naphtha and Stoddard solvent. Oils of lubricating viscosity derived from coal or shale are also useful. Synthetic lubricating oils include hydrocarbon oils and halosubstituted hydrocarbon oils such as polymerized and interpolymerized olefins (e.g., polybutylenes, polypropylenes, propyleneisobutylene copolymers, chlorinated polybutylenes, etc.); poly(1-hexenes), poly(1-octenes), poly(1-decenes), etc. and mixtures thereof; alkylbenzenes (e.g., dodecylbenzenes, tetradecylbenzenes, dinonylbenzenes, di-(2-ethylhexyl)benzenes, etc.); polyphenyls (e.g., biphenyls, terphenyls, alkylated polyphenyls, etc.); alkylated diphenyl ethers and alkylated diphenyl sulfides and the derivatives, analogs and homologs thereof and the like.

Unrefined, refined and rerefined oils, (as well as mixtures of two or more of any of these) can also be used in the present invention. Unrefined oils are those obtained directly from a natural or synthetic source without further purification treatment. For example, a shale oil obtained directly from retorting operations, a petroleum oil obtained directly from primary distillation or ester oil obtained directly from an esterification process and used without further treatment would be an unrefined oil. Refined oils are similar to the unrefined oils except they have been further treated in one or more purification steps to improve one or more properties. Many such purification techniques are known to those skilled in the art such as solvent extraction, secondary distillation, acid or base extraction, filtration, percolation, etc. Rerefined oils are obtained by processes similar to those used to obtain refined oils applied to refined oils which have been already used in service. Such rerefined oils are also known as reclaimed or reprocessed oils and often are additionally processed by techniques directed to removal of spent additives and oil breakdown products.

(D)(8) The Synthetic Ester Base Oil

The synthetic ester base oil comprises the reaction of a monocarboxylic acid of the formula $$R^{19}COOH,$$

a dicarboxylic acid of the formula $$\begin{array}{l} R^{20}\text{—}CHCOOH \\ \quad\quad\quad | \\ \quad\quad (CH_2)_m \\ \quad\quad\quad | \\ \quad\quad CH_2COOH, \end{array}$$

or an aryl carboxylic acid of the formula $$R^{21}\text{—}Ar(COOH)_p$$

wherein $R^{19}$ is a hydrocarbyl group containing from about 4 to about 24 carbon atoms, $R^{20}$ is hydrogen or a hydrocarbyl group containing from about 4 to about 50 carbon atoms, $R^{21}$ is hydrogen or a hydrocarbyl group containing from 1 up to about 24 carbon atoms, m is an integer of from 0 to about 8, and p is an integer of from 1 to 4; with an alcohol of the formula $$R^{22}[O(CH_2\overset{\overset{R^{23}}{|}}{C}HO)_gH]_f$$

wherein $R^{22}$ is an aliphatic, alkoxy or hydroxy alkoxy group containing from 1 to about 30 carbon atoms or an aromatic group containing from 6 to about 18 carbon atoms, $R^{23}$ is hydrogen or an alkyl group containing 1 or 2 carbon atoms, g is from 0 to about 40 and f is from 1 to about 6.

Within the monocarboxylic acid, $R^{19}$ preferably contains from about 6 to about 18 carbon atoms. An illustrative but non-exhaustive list of monocarboxylic acids are the isomeric carboxylic acids of butanoic acid, hexanoic acid, octanoic acid, nonanoic acid, decanoic acid, undecanoic acid, dodecanoic acid, palmitic acid, and stearic acid. Alkenyl carboxylic acids including oleic acid, linoleic acid, linolenic acid, ricinoleic acid and 14-hydroxy-11-eicosenic acid can also be utilized.

Within the dicarboxylic acid, $R^{20}$ preferably contains from about 4 to about 24 carbon atoms and m is an integer of from 1 to about 3. An illustrative but non-exhaustive list of dicarboxylic acids are succinic, glutaric, adipic, pimelic, suberic, azelaic, sebacic, maleic, and fumaric acids.

As aryl carboxylic acids, $R^{21}$ preferably contains from about 6 to about 18 carbon atoms and p is 2. Aryl carboxylic acids having utility are benzoic, toluic, ethylbenzoic, phthalic, isophthalic, terephthalic, hernrimellitic, trimellitic, trimeric, and pyromellitic acids.

Within the alcohols, $R^{22}$ preferably contains from about 3 to about 18 carbon atoms and g is from 0 to about 20. The alcohols may be monohydric, polyhydric or alkoxylated monohydric and polyhydric. Monohydric alcohols can comprise, for example, primary and secondary alcohols. The preferred monohydric alcohols, however are primary aliphatic alcohols, especially aliphatic hydrocarbon alcohols such as alkenols and alkanols. Examples of the preferred monohydric alcohols from which $R^{22}$ is derived include 1-octanol, 1-decanol, 1-dodecanol, I-tetradeconal, 1-hexadecanol, 1-octadecanol, oleyl alcohol, linoleyl alcohol, linolenyl alcohol, phytol, myricyl alcohol lauryl alcohol, myristyl alcohol, cetyl alcohol, stearyl alcohol, and behenyl alcohol.

Examples of polyhydric alcohols are those containing from 2 to about 6 hydroxy groups. They are illustrated, for example, by the alkylene glycols such as ethylene glycol, diethylene glycol, triethylene glycol, tetraethylene glycol, dipropylene glycol, tripropylene glycol, dibutylene glycol, tributylene glycol, and other alkylene glycols. A preferred class of alcohols suitable for use in this invention are those polyhydric alcohols containing up to about 12 carbon atoms. This class of alcohols includes glycerol, erythritol, trimethylolpropane (TMP), pentaerythritol, dipentaerythritol, gluconic acid, glyceraldehyde, glucose, arabinose, 1,7-heptanediol, 2,4-heptanediol, 1,2,3-hexanetriol, 1,2,4-hexanetriol, 1,2,5-hexanetriol, 2,3,4-hexanetriol, 1,2,3-butanetriol, 1,2,4-butanetriol, quinic acid, 2,2,6,6-tetrakis (hydroxymethyl) cyclohexanol, 1–10-decanediol, digitaloal, and the like.

Another preferred class of polyhydric alcohols for use in this invention are the polyhydric alcohols containing 3 to 10 carbon atoms and particularly those containing 3 to 6 carbon atoms and having at least three hydroxyl groups. Such alcohols are exemplified by a glycerol, erythritol, pentaerythritol, mannitol, sorbitol, 2-hydroxymethyl-2-methyl-1,3, propanediol (trimethylolpropane), bis-trimethylolpropane, 1,2,4-hexanetriol and the like.

The alkoxylated alcohols may be alkoxylated monohydric alcohols or alkoxylated polyhydric alcohols. The alkoxy alcohols are generally produced by treating an alcohol with an excess of an alkylene oxide such as ethylene oxide or propylene oxide. For example, from about 6 to about 40 moles of ethylene oxide or propylene oxide may be condensed with an aliphatic alcohol.

In one embodiment, the aliphatic alcohol contains from about 14 to about 24 carbon atoms and may be derived from long chain fatty alcohols such as stearyl alcohol or oleyl alcohol.

The alkoxy alcohols useful in the reaction with the carboxylic acids to prepare synthetic esters are available commercially under such trade names as "TRITON®", "TERGITOL®" from Union Carbide, "ALFONIC®" from Vista Chemical, and "NEODOL®" from Shell Chemical Company. The TRITON® materials are identified generally as polyethoxylated alkyl phenols which may be derived from straight chain or branched chain alkyl phenols. The TERGITOLS® are identified as polyethylene glycol ethers of primary or secondary alcohols; the ALFONIC® materials are identified as ethyoxylated linear alcohols which may be represented by the general structure formula $$CH_3(CH_2)_xCH_2(OCH_2CH_2)_nOH$$

wherein x varies between 4 and 16 and n is a number between about 3 and 11. Specific examples of ALFONIC® ethoxylates characterized by the above formula include ALFONIC® 1012-60 wherein x is about 8 to 10 and n is an average of about 5.7; ALFONIC® 1214-70 wherein x is about 10–12 and n is an average of about 10.6; ALFONIC® 1412-60 wherein x is from 10–12 and n is an average of about 7; and ALFONIC® 1218-70 wherein x is about 10–16 and n is an average of about 10.7.

The NEODOL® ethoxylates are ethoxylated alcohols wherein the alcohols are a mixture of linear and branched alcohols containing from 9 to about 15 carbon atoms. The ethoxylates are obtained by reacting the alcohols with an excess of ethylene oxide such as from about 3 to about 12 or more moles of ethylene oxide per mole of alcohol. For example, NEODOL® ethoxylate 23–6.5 is a mixed linear and branched chain alcoholate of 12 to 13 carbon atoms with an average of about 6.5 ethoxy units.

As stated above, the synthetic ester base oil comprises reacting any above-identified acid or mixtures thereof with any above-identified alcohol or mixtures thereof at a ratio of 1 COOH per 1 OH group using esterification procedures, conditions and catalysts known in the art.

A non-exhaustive list of companies that produce synthetic esters and their trade names are BASF as Glissofluid, Ciba-Geigy as Reolube, JCI as Emkarote, Oleofina as Radialube and the Emery Group of Henkel Corporation as Emery.

The composition of the present invention comprising components (A), (B) and (C) or (A), (B), (C) and (D) are useful as industrial lubricants.

When the composition comprises components (A), (B) and (C), the following states the ranges of these components in parts by weight.

| Component | Generally | Preferred | Most Preferred |
|---|---|---|---|
| (A) | 80–99.8 | 90–99.8 | 95–99.8 |
| (B) | 0.1–10 | 0.1–5 | 0.1–2.5 |
| (C) | 0.1–10 | 0.1–5 | 0.1–2.5 |

When the composition comprises components (A), (B), (C) and (D), the following states the ranges of these components in part by weight.

| Component | Generally | Preferred | Most Preferred |
|---|---|---|---|
| (A) | 30–99.7 | 60–99.7 | 80–99.7 |
| (B) | 0.1–10 | 0.1–10 | 0.1–5 |
| (C) | 0.1–10 | 0.1–10 | 0.1–5 |
| (D) | 0.1–50 | 0.1–20 | 0.1–10 |

It is understand that other components besides (A), (B), (C) and (D) may be present within the composition of this invention.

The components of this invention are blended together according to the above ranges to effect solution. The following Table I outlines examples so as to provide those of ordinary skill in the art with a complete disclosure and description on how to make the composition of this invention and is not intended to limit the scope of what the inventor regards as the invention. All parts are by weight.

A portion of the Table I data shows scanning Brookfield viscosity measurements wherein the viscosity at various centipoises is recorded as a function of temperature.

TABLE I

| | | | | | | | Scanning Brookfield Viscosity (ASTM D5133) | | | |
|---|---|---|---|---|---|---|---|---|---|---|
| Example | (A) | (B) | (C) | (D) | Pour Point ° C. | Freeze Point ° C. | Temperature at 10,000 cP | Temperature at 20,000 cP | Temperature at 30,000 cP | Temperature at 40,000 cP |
| 1 | 100 parts Sunyl 80 oil | | | | −12 | −14.6 | −14.3 | −15.0 | −15.5 | |
| 2 | 97 parts Sunyl 80 oil | 1 part Glissoviscal SGH | 2 parts Acryloid 1267 | | −18 | −19.3 | −10.1 | −16.4 | −18.2 | |
| 3 | 97 parts Sunyl 80 oil | 1 part Glissoviscal SGH | 2 parts Viscoplex 10-930 | | −21 | −23.6 | −11.0 | −16.4 | −17.1 | |
| 4 | 97 parts Sunyl 80 oil | 1 part Glissoviscal SGH | 2 parts TLA 233 | | −24 | −25.7 | −16.2 | −17.7 | −18.8 | −19.7 |
| 5 | 77.6 parts Sunyl 80 oil | 1 part Glissoviscal SGH | 2 parts Acryloid 1267 | 19.4 parts Glissofluid A-9 | −24 | −26.4 | −13.5 | −21.2 | −23.6 | −24.6 |
| 6 | 77.6 parts Sunyl 80 oil | 1 part Glissoviscal SGH | 2 parts Viscoplex 10-930 | 19.4 parts Glissofluid A-9 | −27 | −29.9 | −14.1 | −19.2 | −20 | |
| 7 | 77.6 parts Sunyl 80 oil | 1 part Glissoviscal SGH | 2 parts TLA 233 | 19.4 parts Glissofluid A-9 | −30 | −30.2 | −22.5 | −24.1 | −25.3 | |
| 8 | 67.9 parts Sunyl 80 oil | 1 part Glissoviscal SGH | 2 parts Acryloid 1267 | 19.1 parts Emery 2964 | −24 | −25.3 | −15.2 | −17.2 | −18.7 | |
| 9 | 67.9 parts Sunyl 80 oil | 1 part Glissoviscal SGH | 2 parts Viscoplex 10-930 | 29.1 parts Emery 2964 | −27 | −29.2 | −17.3 | −20.9 | −22.9 | −24.1 |
| 10 | 67.9 parts Sunyl 80 oil | 1 part Glissoviscal SGH | 2 parts TLA 233 | 29.1 parts Emery 2964 | −30 | −31.3 | −21.8 | −24.4 | −26.8 | |

TABLE I-continued

| Example | (A) | (B) | (C) | (D) | Pour Point ° C. | Freeze Point ° C. | Scanning Brookfield Viscosity (ASTM D5133) Temperature at 10,000 cP | Temperature at 20,000 cP | Temperature at 30,000 cP | Temperature at 40,000 cP |
|---|---|---|---|---|---|---|---|---|---|---|
| 11 | 67.9 parts Sunyl 80 oil | 1 part Glissoviscal SG | 2 parts Acryloid 1267 | 29.1 parts Emery 2964 | −24 | −25.7 | −14.2 | −15.2 | −16.5 | −17.6 |
| 12 | 67.9 Sunyl 80 oil | 1 part Glissoviscal SG | 2 parts Viscoplex 10-930 | 29.1 parts Emery 2964 | +30 | −30.5 | −15.6 | −16.3 | −17.1 | |
| 13 | 67.9 Sunyl 80 oil | 1 part Glissoviscal SG | 2 parts TLA 233 | 29.1 parts Emery 2964 | −30 | −32.4 | −20.6 | −24.6 | −27.6 | −29.7 |

While the invention has been explained in relation to its preferred embodiments, it is to be understood that various modifications thereof will become apparent to those skilled in the art upon reading the specification. Therefore, it is to be under stood that the invention disclosed herein is intended to cover such modifications as fall within the scope of the appended claims.

What is claimed is:

1. A composition, comprising;

(A) from about 95–98.8 parts by weight of at least one vegetable oil or synthetic triglyceride oil of the formula

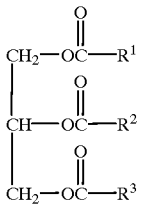

wherein $R^1$, $R^3$ are aliphatic groups that are at least 60 percent monounsaturated and contain from about 7 to about 23 carbon atoms, or a derivative thereof;

(B) from about 0.1–2.5 parts by weight of a hydrogenated block copolymer comprising a normal block copolymer or a random block copolymer, said normal block copolymer made from a vinyl substituted aromatic and an aliphatic conjugated diene, said normal block copolymer having from two to about five polymer blocks with at least one polymer block of said vinyl substituted aromatic and at least one polymer block of said aliphatic conjugated diene, said random block copolymer made from vinyl substituted aromatic and aliphatic conjugated diene monomers, the total amount of said vinyl substituted aromatic blocks in said block copolymer being in the range of from about 20 percent to about 70 percent by weight and the total amount of said diene blocks in said block copolymer being in the range of from about 30 percent to about 80 percent by weight; the number average molecular weight of said normal block copolymer and said random block copolymer being in the range of about 5,000 to about 1,000,000; and (C) from about 0.1–2.5 parts by weight of at least one pour point depressant.

2. The composition of claim 1 wherein $R^1$, $R^2$ and $R^3$ independently contain from about 11 to about 21 carbon atoms.

3. The composition of claim 1 wherein the monounsaturation of the $R^1$, $R^2$ and $R^3$ groups is due to an oleic acid residue and further wherein an oleic acid moiety:linoleic acid moiety is from 2 up to about 90.

4. The composition of claim 3 wherein the vegetable oil is a high oleic vegetable oil.

5. The composition of claim 4 wherein the high oleic vegetable oil comprises high oleic safflower oil, high oleic corn oil, high oleic rapeseed oil, high oleic sunflower oil, high oleic soybean oil, high oleic cottonseed oil, high oleic canola oil and high oleic peanut oil.

6. The composition of claim 1 wherein the synthetic triglyceride is an ester of at least one straight chain monounsaturated fatty acid and glycerol wherein the fatty acid contains from about 7 to about 23 carbon atoms.

7. The composition of claim 6 wherein the monounsaturated fatty acid is oleic acid.

8. The composition of claim 1 wherein the natural oil derivatives are esters from the transesterification of at least one animal or vegetable oil triglyceride of the formula

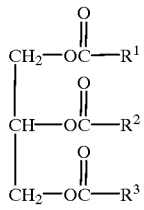

with an alcohol or phenol $R^4OH$ wherein $R^1$, $R^2$ and $R^3$ are aliphatic groups containing from about 7 to about 23 carbon atoms and $R^4$ is an aliphatic group containing from 1 to about 18 carbon atoms or an aromatic or substituted aromatic group containing from 6 to about 50 carbon atoms.

9. The composition of claim 1 wherein said (B) normal block copolymer has a total of two or three polymer blocks, wherein the number average molecular weight of said normal block and said random copolymer is from about 30,000 to about 200,000, wherein in said block copolymer the total amount of said conjugated diene is from about 40% to about 60% by weight and the total amount of said vinyl substituted aromatic is from about 40% to about 60% by weight.

10. The composition of claim 9 wherein said conjugated diene is isoprene or butadiene, wherein said vinyl substituted aromatic is styrene, and wherein said (b) hydrogenated normal block copolymer and random block copolymer contain no more than 0.5% residual olefinic unsaturation.

11. The composition of claim 1 wherein the pour point depressant is an ester characterized by low-temperature modifying properties of an ester of a carboxy-containing interpolymer, said interpolymer having a reduced specific viscosity of from about 0.05 to about 2 and being derived from at least two monomers, one of said monomers being a low molecular weight aliphatic olefin, styrene or a substituted styrene wherein the substituent is a hydrocarbyl group containing from 1 up to about 18 carbon atoms, and the other of said monomers being an alpha, beta-unsaturated aliphatic acid, anhydride or ester thereof, said ester being substantially free of titratable acidity and being characterized by the presence within its polymeric structure of pendant polar groups which are derived from the carboxy groups of said ester:

(a) a relatively high molecular weight carboxylic ester group, said carboxylic ester group having at least 8 aliphatic carbon atoms in the ester radical, optionally (b) a relatively low molecular weight carboxylic ester group having no more than 7 aliphatic carbon atoms in the ester radical, wherein the molar ratio of (a):(b) of the pour point depressant when (b) is present is (1–20): 1, and optionally (c) a carbonyl-amino group derived from an amino compound having one primary or secondary amino group, wherein the molar ratio of (a):(b):(c) of the pour point depressant when (b) and (c) are present is (50–100): (5–50):(0.1–15).

12. The composition of claim 11 wherein said mixed ester of the interpolymer is characterized by low-temperature modifying properties of an ester of a carboxy-containing interpolymer, said interpolymer having a reduced specific viscosity of from about 0.05 to about 2 and being derived from at least two monomers, the one being ethylene, propylene, butylene, styrene substituted styrene wherein the substituent is a hydrocarbyl group containing from 1 up to about 18 carbon atoms, or an alpha olefin that contains from 6 up to 30 carbon atoms and the other of said monomers being maleic acid or anhydride, itaconic acid or anhydride or acrylic acid or ester, said ester being substantially free of titratable acidity and being characterized by the presence within its polymeric structure of at least one of each of three pendant polar groups which are derived from the carboxy groups of said ester:

(a) a relatively high molecular weight carboxylic ester group, said carboxylic ester group having at least 8 aliphatic carbon atoms in the ester radical, (b) a relatively low molecular weight carboxylic ester group having no more than 7 aliphatic carbon atoms in the ester radical, wherein the molar ratio of (a):(b) of the pour point depressant is (1–20): 1, and optionally (c) a carbonyl-amino group derived from an amino compound having one primary or secondary amino radical, wherein the molar ratio of (a):(b):(c) of the pour point depressant when (c) is present (50–100):(5–50): (0.1–15).

13. The composition of claim 11 wherein the molar ratio of (a):(b) of the pour point depressant is (1–10): 1.

14. The composition of claim 11 wherein the molar ratio of (a):(b):(c) of the pour point depressant is (70–85):(15–30) :(3–4).

15. The composition of claim 11 wherein the interpolymer is a styrene-maleic anhydride interpolymer having a reduced specific viscosity of from about 0.1 to about 1.

16. The composition of claim 11 wherein the relatively high molecular weight carboxylic ester group of (a) has from 8 to 24 aliphatic carbon atoms, the relatively low molecular weight carboxylic ester group of (b) has from 3 to 5 carbon atoms and the carbonyl-amino group of (c) is derived from a primary-aminoalkyl-substituted tertiary amine.

17. The composition of claim 11 wherein the carboxy-containing interpolymer is a terpolymer of one molar proportion of styrene, one molar proportion of maleic anhydride, and less than about 0.3 molar proportion of a vinyl monomer.

18. The composition of claim 11 wherein said low molecular weight aliphatic olefin of said nitrogen-containing ester is selected from the group consisting of ethylene, propylene or isobutene.

19. The composition of claim 1 wherein the pour point depressant is an acrylate polymer of the formula

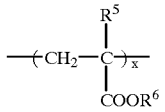

wherein $R^5$ is hydrogen or a lower alkyl group containing from 1 to about 4 carbon atoms, $R^6$ is a mixture of alkyl, cycloalkyl or aromatic groups containing from about 1 to about 24 carbon atoms, and x is an integer providing a weight average molecular weight (Mw) to the acrylate polymer of about 5000 to about 1,000,000.

20. The composition of claim 19 wherein $R^5$ is a methyl group.

21. The composition of claim 19 wherein the molecular weight of the polymer is from about 50,000 to about 500,000.

22. The composition of claim 1 wherein the pour point depressant is a mixture of compounds having the general structural formula $$Ar\text{-}(\text{-}(R^7)\text{-}X_{n'}\text{-}[Ar'(R^8)]_n\text{-}Ar''$$

wherein the Ar, Ar' and Ar'' are independently an aromatic moiety containing 1 to 3 aromatic rings and the mixture includes compounds wherein moieties are present with 0 substituents, 1 substituent, 2 substituents and 3 substituents, $R^7$ and $R^8$ are independently an alkylene containing about 1 to 100 carbon atoms, n is 0 to 1000, n' is 0 or 1 and X is a hydrocarbylene group containing from 1 up to 24 carbon atoms.

23. The mixture as claimed in claim 22 including compounds having a molecular weight ranging from about 300 to about 300,000.

24. The mixture as claimed in claim 22 including compounds having a molecular weight ranging from about 300 to about 10,000.

25. The composition of claim 1 wherein the pour point depressant is a nitrogen containing polymer prepared by polymerizing an acrylate ester monomer of the formula

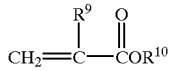

wherein $R^9$ is hydrogen or an alkyl group containing from 1 to about 8 carbon atoms and $R^{10}$ is an alkyl, cycloalkyl or aromatic group containing from 1 to about 30 carbon atoms with a nitrogen-containing monomer at from 0.001–1.0 moles of the nitrogen containing monomer for each mole of the acrylate ester monomer.

26. The composition of claim 25 wherein the nitrogen-containing monomer is selected from the group consisting of 4-vinylpyridine, 2-vinylpyridine, 2-N-morpholinoethyl methacrylate, N,N-dimethylaminoethyl methacrylate and N,N-dimethylaminopropyl methacrylate.

27. The composition of claim 1 further comprising (D) at least one performance additive selected from the group consisting of (1) at least one alkyl phenol of the formula

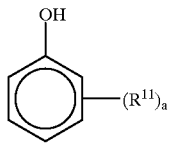

wherein $R^{11}$ is an alkyl group containing from 1 up to about 24 carbon atoms and a is an integer of from 1 up to 5;

(2) a benzotriazole of the formula

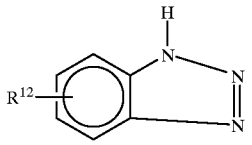

wherein $R^{12}$ is hydrogen or an alkyl group of 1 up to about 24 carbon atoms;

(3) a thiocarbamate of the formula

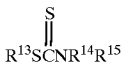

wherein $R^{13}$ is an alkyl group containing from 1 to about 24 carbon atoms, phenyl or alkyl phenyl wherein the alkyl group contains from 1 to about 18 carbon atoms, $R^{14}$ and $R^{15}$ are hydrogen or an alkyl group containing from 1 to about 6 carbon atoms, with the proviso that $R^{14}$ and $R^{15}$ are not both hydrogen;

(4) a sulfurized composition wherein the sulfurized composition is prepared by sulfurizing at a temperature of about 1000 to about 250° C. a mixture comprising (a) 100 parts of an animal or vegetable oil triglyceride of the formula

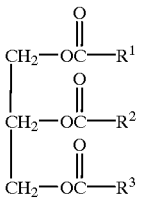

wherein $R^1$, $R^2$ and $R^3$ are aliphatic groups containing from about 7 to about 23 carbon atoms, (b) from about 2 to about 50 parts of at least one alkenyl carboxylic acid containing from about 8 to about 30 carbon atoms, (c) from about 25 to 400 parts by weight of at least one substantially monolefin containing from about 8 to about 36 carbon atoms;

(5) a viscosity index improver;

(6) an aromatic amine of the formula wherein $R^{16}$ is

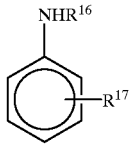

wherein $R^{16}$ is

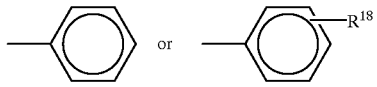

and $R^{17}$ and $R^{18}$ are independently a hydrogen or an alkyl group containing from 1 up to about 24 carbon atoms;

(7) a synthetic ester base oil comprising the reaction of a monocarboxylic acid of the formula $R^{19}COOH$, a dicarboxylic acid of the formula

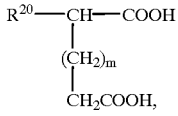

or an aryl carboxylic acid of the formula $R^{21}$—Ar$(COOH)_p$ wherein $R^{19}$ is a hydrocarbyl group containing from about 4 to about 24 carbon atoms, $R^{20}$ is hydrogen or a hydrocarbyl group containing from about 4 to about 50 carbon atoms, $R^{21}$ is hydrogen or a hydrocarbyl group containing from 1 up to about 24 carbon atoms, m is an integer of from 0 to about 8, and p is an integer of from 1 to 4; with an alcohol of the formula

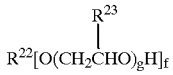

wherein $R^{22}$ is an aliphatic, alkoxy or hydroxyalkoxy group containing from 1 to about 30 carbon atoms or an aromatic group containing from 6 to about 18 carbon atoms, $R^{23}$ is hydrogen or an alkyl group containing 1 or 2 carbon atoms, g is from 0 to about 40 and f is from 1 to about 6.

28. The composition of claim 27 wherein within (D)(1) a is 2 and $R^{11}$ contain from 1 up to about 8 carbon atoms.

29. The composition of claim 28 wherein the alkyl phenol is of the formula

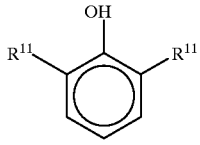

wherein $R^{11}$ is t-butyl.

30. The composition of claim 27 wherein within (D)(2) $R^{12}$ is hydrogen or an alkyl group containing from 1 up to about 8 carbon atoms.

31. The composition of claim 27 wherein within (D)(2) $R^{12}$ is a methyl group.

32. The composition of claim 27 wherein witn (D)(6) $R^{16}$ is

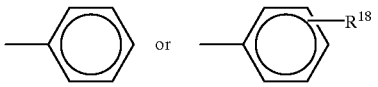

and $R^{17}$ and $R^{18}$ are independently a hydrogen or an alkyl group containing from 4 up to 18 carbon atoms.

33. The composition of claim 32 wherein $R^{17}$ and $R^{18}$ are nonyl groups.

34. The composition of claim 27 wherein the weight ratio of (A):

(B): (C): (D) is from (30–99.7): (0.1–10) (0.1–10): (.1–50).

35. The composition of claim 27 wherein the weight ratio of (A):

(B): (C): (D) is from (60–99.7): (0.1–10): (0.1–10): (0.1–20).

36. The composition of claim 27 wherein the weight ratio of (A):

(B): (C): (D) is from (80–99.7): (0.1–5): (0.1–5): (0.1–10).

* * * * *